US011072763B2

(12) United States Patent
Braeckman et al.

(10) Patent No.: US 11,072,763 B2
(45) Date of Patent: Jul. 27, 2021

(54) CLEANING COMPOSITION

(71) Applicant: The Procter & Gamble Company, Cincinnati, OH (US)

(72) Inventors: Karl Ghislain Braeckman, Gerpinnes (BE); Nuray Yaldizkaya, Ghent (BE)

(73) Assignee: The Procter & Gamble Company, Cincinnati, OH (US)

( * ) Notice: Subject to any disclaimer, the term of this patent is extended or adjusted under 35 U.S.C. 154(b) by 62 days.

(21) Appl. No.: 16/127,742

(22) Filed: Sep. 11, 2018

(65) Prior Publication Data

US 2019/0078038 A1 Mar. 14, 2019

(30) Foreign Application Priority Data

Sep. 13, 2017 (EP) ..... 17190749
Apr. 20, 2018 (EP) ..... 18168384

(51) Int. Cl.

| | |
|---|---|
| ***C11D 3/30*** | (2006.01) |
| ***C11D 1/94*** | (2006.01) |
| ***C11D 11/00*** | (2006.01) |
| ***C11D 3/00*** | (2006.01) |
| ***C11D 1/83*** | (2006.01) |
| *C11D 1/66* | (2006.01) |

(Continued)

(52) U.S. Cl.

CPC ..... *C11D 3/30* (2013.01); *C11D 1/83* (2013.01); *C11D 1/94* (2013.01); *C11D 3/0094* (2013.01); *C11D 11/0023* (2013.01); *C11D 1/12* (2013.01); *C11D 1/146* (2013.01); *C11D 1/29* (2013.01); *C11D 1/662* (2013.01); *C11D 1/75* (2013.01); *C11D 1/88* (2013.01)

(58) Field of Classification Search

CPC ..... C11D 3/30; C11D 11/94

See application file for complete search history.

(56) References Cited

U.S. PATENT DOCUMENTS 3,625,906 A * 12/1971 Alsbury ..... C11D 10/042 510/153
5,576,277 A * 11/1996 MacBeath ..... C11D 1/37 510/113

(Continued)

FOREIGN PATENT DOCUMENTS

CA 2843252 A1 * 1/2013 ..... C11D 3/2093
EP 1479755 A1 * 11/2004 ..... C11D 17/0091

(Continued)

OTHER PUBLICATIONS

European Search Report for Application No. 17190749.6-1105, dated Mar. 3, 2018, 7 pages.

(Continued)

*Primary Examiner* — Liam J Heincer
*Assistant Examiner* — M. Reza Asdjodi
(74) *Attorney, Agent, or Firm* — Melissa G Krasovec

(57) ABSTRACT

The present invention relates to a hand dishwashing cleaning composition. In particular, the composition includes a surfactant system, the surfactant system includes an anionic surfactant having a weight average degree of alkyl branching between 41% and 50% and a primary co-surfactant selected from the group consisting of amphoteric surfactant, zwitterionic surfactant and mixtures thereof, and wherein the composition further includes a specific cyclic polyamine.

19 Claims, 1 Drawing Sheet

| Inventive Composition 1 (42% branching AES with Baxxodur™ ECX210) | Comparative Composition 5 (33% branching AES and nil Baxxodur™ ECX210) |
|---|---|
|  |  |

Grease Emulsification Properties of Inventive Composition vs. Comparative Composition

(51) Int. Cl.

| | |
|---|---|
| *C11D 1/12* | (2006.01) |
| *C11D 1/75* | (2006.01) |
| *C11D 1/29* | (2006.01) |
| *C11D 1/88* | (2006.01) |
| *C11D 1/14* | (2006.01) |

(56) References Cited

U.S. PATENT DOCUMENTS 5,804,544 A * 9/1998 Powell ..... C11D 1/37 510/228
5,891,837 A * 4/1999 Baillely ..... C01B 15/106 252/186.22
6,391,839 B1 * 5/2002 Addison ..... C11D 1/37 510/315
6,710,023 B1 * 3/2004 Bodet ..... C11D 1/83 510/235
8,168,005 B2 * 5/2012 Borne ..... C11D 1/83 134/25.2
9,725,682 B2 * 8/2017 Hulskotter ..... C11D 3/04
2002/0132747 A1 * 9/2002 Huyhn ..... A47L 17/08 510/218
2006/0172908 A1 * 8/2006 Everaert ..... C11D 1/83 510/235
2007/0275868 A1 * 11/2007 Cooremans ..... C11D 3/3723 510/475
2011/0312868 A1 * 12/2011 Buisker ..... C11D 1/94 510/236
2014/0221266 A1 * 8/2014 Keuleers ..... C11D 1/12 510/235
2015/0267149 A1 * 9/2015 Chen ..... C11D 1/94 510/237
2015/0267150 A1 * 9/2015 Chen ..... C11D 11/0023 510/237
2015/0315523 A1 * 11/2015 Hulskotter ..... C11D 3/386 510/226
2015/0315526 A1 * 11/2015 Hulskotter ..... C11D 1/66 510/235
2015/0344821 A1 * 12/2015 Bettiol ..... C11D 1/143 510/237
2016/0177224 A1 * 6/2016 Braeckman ..... C11D 1/14 510/237
2016/0355758 A1 * 12/2016 Lant ..... C11D 3/38627
2017/0015943 A1 * 1/2017 Braeckman ..... C11D 11/0023
2017/0096513 A1 * 4/2017 Karagianni ..... C08F 226/10
2017/0121637 A1 * 5/2017 Delplancke ..... C11D 1/75
2017/0121653 A1 * 5/2017 Hoefte ..... C11D 1/66
2017/0121654 A1 * 5/2017 Hoefte ..... C11D 1/29
2017/0121655 A1 * 5/2017 Delplancke ..... A47L 15/4278
2018/0119059 A1 * 5/2018 Miracle ..... C11D 3/40
2019/0078038 A1 * 3/2019 Braeckman ..... C11D 3/30
2019/0161703 A1 * 5/2019 Delplancke ..... C11D 1/94

FOREIGN PATENT DOCUMENTS

EP 2420557 A1 * 2/2012 ..... C11D 11/0023
EP 2757144 A1 7/2014
EP 3162881 A1 5/2017
JP 2005171173 A 6/2005
JP 2007016131 A 1/2007
WO WO-0244312 A2 * 6/2002 ..... C11D 3/0094
WO WO0244312 A2 6/2002
WO WO-2015082726 A1 * 6/2015 ..... C11D 3/0094
WO WO-2015139220 A1 * 9/2015 ..... C08F 226/10
WO WO2017074974 A1 5/2017

OTHER PUBLICATIONS

Extended European Search Report and Search Opinion; Application No. 18168384.8, dated Oct. 16, 2018, 8 pages.

* cited by examiner

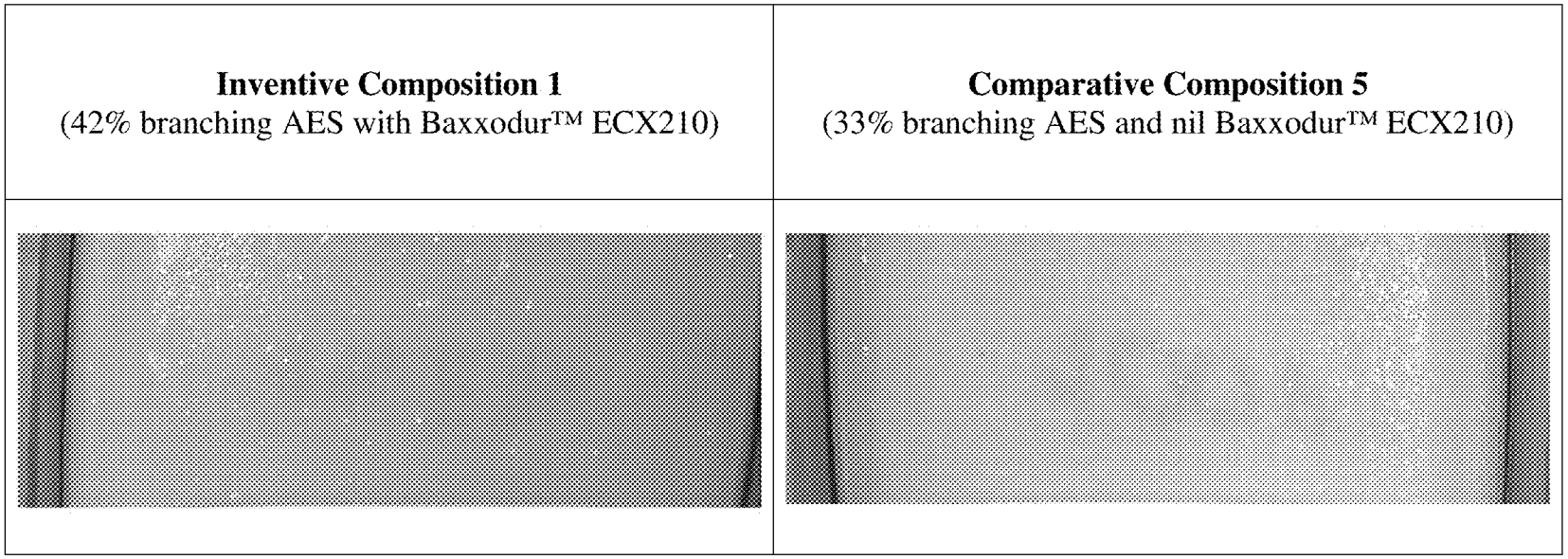
Grease Emulsification Properties of Inventive Composition vs. Comparative Composition

CLEANING COMPOSITION

FIELD OF THE INVENTION

The present invention relates to a cleaning composition. In particular, it relates to a hand dishwashing cleaning composition comprising a surfactant system comprising a highly branched anionic surfactant and a specific cyclic polyamine. The composition has a at least one of enhanced suds stabilization, enhanced suds consistency and enhanced suds whiteness. The composition also provides good grease cleaning and grease emulsification under a wide range of dilutions.

BACKGROUND OF THE INVENTION

Consumers are constantly looking for dishwashing products that can deliver improved and long-lasting cleaning performance, particularly grease cleaning. To evaluate whether the product is still performing they look at suds profile as a signal of cleaning performance. More particularly, consumers will evaluate at least one of the following suds parameters: the amount of remaining suds (i.e., the more the better), the consistency of the remaining suds (i.e., preference for dense suds vs. large bubble size/watery suds), and the whiteness of the remaining suds (i.e., the whiter the better).

Accordingly, detergent formulators are aiming to formulate a product having at least one, if not all, of the properties of a high volume, dense and white suds that can be sustained as long as possible during the washing process. The challenge that formulators face is that as soil is being removed during the washing process, suds volume tends to drop, the suds tend to lose consistency turning into larger bubble size watery suds, and the suds tend to become colored. These notable changes in the suds profile drive consumers to re-dosing the detergent product more frequently. If these undesirable changes in the suds profile can be prevented or slowed down, then the consumer would re-dose less frequently, as such causing the consumer to perceive a higher value for money paid and/or higher product quality. The additional benefit of less re-dosing (i.e., less consumption) is reduced impact on the environment. Cyclic polyamines are known to be good for grease cleaning. However, previous attempts to improve sudsing profile have not focused on the use of cyclic polyamines in combination with a highly branched anionic surfactant to enhance retention of suds volume, suds density and/or suds whiteness through-out the wash.

The challenge is further complicated by the fact that consumers have different washing habits. Some consumers like to wash in a sink full of water containing the dishwashing detergent, while others prefer to apply the dishwashing detergent onto the cleaning implement and wash under running water. Consequently, detergent formulators need to ensure that the hand dishwashing detergent needs to be designed to perform well under a wide range of dilutions.

Thus, the need remains for a cleaning composition that possesses a good sudsing profile for use with different types of hand dishwashing habits and wash conditions. The need also exists for a cleaning composition that provides good cleaning, in particular cleaning of soils and/or grease removal. The need also exists for a cleaning composition that beyond strong grease cleaning also provides good grease emulsification such that re-deposition of the greasy soil on the dishware or onto the sink is substantially reduced or prevented. The Applicant has discovered that some or all of the above-mentioned needs can be at least partially fulfilled through cleaning compositions as described herein below.

SUMMARY OF THE INVENTION

In one aspect, the present invention addresses these needs by providing a hand dishwashing cleaning composition comprising from 1% to 60%, preferably from 5% to 50%, more preferably from 8% to 45%, most preferably from 15% to 40%, by weight of the total composition of a surfactant system, and from 0.1% to 5%, preferably from 0.1% to 2%, by weight of the composition of a cyclic polyamine. The surfactant system comprises an anionic surfactant and a primary co-surfactant. The anionic surfactant is selected from sulfate anionic surfactant, preferably alkyl sulfate, alkyl alkoxy sulfate, preferably alkyl ethoxy sulfate, or mixtures thereof, wherein the anionic surfactant has a weight average degree of alkyl branching between 41% and 50%. The primary co-surfactant is selected from the group consisting of an amphoteric surfactant, a zwitterionic surfactant and mixtures thereof, preferably an amphoteric surfactant, preferably an amine oxide surfactant. The cyclic polyamine is a cyclic polyamine of Formula (I):

(I)

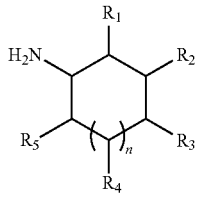

wherein the radicals $R_1$, $R_2$, $R_3$, $R_4$ and $R_5$ are independently selected from NH2, —H, linear or branched alkyl or alkenyl having from 1 to 10 carbon atoms and n is from 1 to 3, preferably 1 and wherein at least one of the radicals is NH2.

In another aspect, the hand dishwashing cleaning composition of the invention comprises from 15% to 40% by weight of the composition of a surfactant system and from 0.1% to 2% by weight of the composition of a specific cyclic diamine. The surfactant system comprises an anionic surfactant and an amine oxide co-surfactant, preferably an alkyl dimethyl amine oxide co-surfactant. The anionic surfactant has a weight average degree of branching of from 41% to 50% and an average degree of ethoxylation of between 0.5 and 0.9 and an average alkyl chain length of between C12 and C14. The weight ratio of the anionic surfactant and the amine oxide co-surfactant is between 2.5:1 and 4:1. The cyclic diamine is selected from the group consisting of 2-methylcyclohexane-1,3-diamine, 4-methylcyclohexane-1,3-diamine and mixtures thereof.

According to another aspect of the invention there is provided a method of manually washing dishware using the composition of the invention. The method comprises the steps of: a) delivering a composition of the invention onto soiled dishware or a cleaning implement; b) cleaning the dishware with the composition in the presence of water; and c) optionally, rinsing the dishware.

According to yet another aspect of the invention there is provided a method of manually washing dishware comprising the steps of delivering a composition of the invention into a volume of water to form a wash solution and immersing the dishware into the solution.

There is also provided the use of the composition of the invention for providing at least one of enhancing the stabilization of suds of the composition, enhancing the retention of suds consistency of the composition, and enhancing the retention of suds whiteness of the composition through-out the wash process. There is also provided the use of the composition of the invention to provide grease cleaning and grease emulsification such that grease re-deposition is substantially reduced or prevented.

One aim of the present invention is to provide a hand dishwashing cleaning composition which can exhibit at least one, if not all, of the properties of a high volume, dense and white suds that can be sustained as long as possible during the washing process. In particular, the good sudsing profile is exhibited under different consumer washing habits of full sink washing condition and/or under direct application of product on a cleaning implement and washing under tap.

Another aim of the present invention is to provide such a hand dishwashing cleaning composition having a good sudsing profile, in particular long lasting suds, especially longer lasting suds volume, suds consistency and/or suds whiteness, under a wide range of dilution conditions.

Another aim of the present invention is to provide such a hand dishwashing cleaning composition of the present invention having good cleaning, in particular good cleaning of light and/or tough soils, and/or grease removal.

Another aim of the present invention is to provide such a hand dishwashing cleaning composition of the present invention having good grease emulsification such that grease re-deposition beyond cleaning is substantially reduced or prevented.

Another aim of the present invention is to provide such a hand dishwashing cleaning composition of the present invention that is stable upon storage and shipping, even under stressed conditions.

These and other features, aspects and advantages of the present invention will become evident to those skilled in the art from the detailed description which follows.

BRIEF DESCRIPTION OF THE DRAWINGS

While the specification concludes with claims particularly pointing out and distinctly claiming the invention, it is believed that the invention will be better understood from the following description of the accompanying FIGURE:

FIG. 1 shows a picture of the resulting tub covers exposed to a wash solution of an inventive composition (Inventive Composition 1) comprising the highly branched anionic surfactant and the cyclic polyamine according to the invention, vs. a wash solution of a comparative composition (Comparative Composition 5) not comprising the highly branched anionic surfactant and the cyclic polyamine according to the invention, according to the Grease Emulsification Test as described herein.

DETAILED DESCRIPTION OF THE INVENTION

Definitions

As used herein, articles such as "a" and "an" when used in a claim, are understood to mean one or more of what is claimed or described.

The term "comprising" as used herein means that steps and ingredients other than those specifically mentioned can be added. This term encompasses the terms "consisting of" and "consisting essentially of". The compositions of the present invention can comprise, consist of, and consist essentially of the essential elements and limitations of the invention described herein, as well as any of the additional or optional ingredients, components, steps, or limitations described herein.

The term "dishware" as used herein includes cookware and tableware made from, by non-limiting examples, ceramic, china, metal, glass, plastic (e.g., polyethylene, polypropylene, polystyrene, etc.) and wood.

The term "grease" as used herein means materials comprising at least in part (i.e., at least 0.5 wt % by weight of the grease) saturated and unsaturated fats and oils, preferably oils and fats derived from animal sources such as beef, pig and/or chicken.

The terms "include", "includes" and "including" are meant to be non-limiting.

The term "sudsing profile" as used herein refers to the properties of a cleaning composition relating to suds character during the dishwashing process. For example, the sudsing profile of a cleaning composition includes but is not limited to the suds volume generated upon dissolving and agitation, typically manual agitation, of the cleaning composition in the aqueous washing solution, and the retention of the suds during the dishwashing process. Preferably, hand dishwashing cleaning compositions of the present invention are characterized as having a "good sudsing profile" possess at least one, if not all, of the properties of high suds volume, dense suds consistency and white suds appearance. This is important as the consumer uses sudsing profile as an indicator of the performance of the cleaning composition. Moreover, the consumer also uses the sudsing profile as an indicator that the wash solution still contains active cleaning ingredients, even towards the end of the dishwashing process.

It is understood that the test methods that are disclosed in the Test Methods Section of the present application must be used to determine the respective values of the parameters of Applicant's inventions as described and claimed herein.

In all embodiments of the present invention, all percentages are by weight of the total composition, as evident by the context, unless specifically stated otherwise. All ratios are weight ratios, unless specifically stated otherwise, and all measurements are made at 25° C., unless otherwise designated.

Cleaning Composition

The present invention relates to cleaning compositions having a good sudsing profile. In particular, the cleaning compositions have at least one, if not all, of the properties of high suds volume, dense suds consistency and white suds appearance. It has been found that formulating with highly branched anionic surfactant system can enhance retention of suds volume during the dishwashing process, i.e., provide good suds mileage. However, such systems are not very good at sustaining suds consistency and white suds appearance during the dishwashing process. The Applicant has surprisingly discovered that by combining a highly branched anionic surfactant system according to the invention with a specific cyclic polyamine, more consistent dense suds, more sustained suds whiteness and more sustained high suds volume can be achieved through-out the washing process. The results are unexpected since addition of the selected cyclic polyamine on top of a lower branched anionic surfactant system, as they have been described in the prior art when targeting cleaning benefits, has been shown to result in a fast drop in suds consistency, as shown within the example section described herein.

Furthermore, the compositions of the present invention present good stability due to the compatibility of the surfactant system with the remaining ingredients of the composition. The composition can also be aesthetically pleasant because the presence of the surfactant system and the specific cyclic polyamine do not alter the appearance of the composition, i.e., transparent, translucent, etc. The composition of the present invention can also provide good grease removal, in particular good uncooked grease removal, grease emulsification and as such grease re-deposition reduction or prevention.

The cleaning composition is preferably a hand dishwashing cleaning composition, preferably in liquid form. Preferably, the composition contains from 50% to 85%, preferably from 50% to 75% by weight of the total composition of a liquid carrier in which the other essential and optional components are dissolved, dispersed or suspended. One preferred component of the liquid carrier is water.

Preferably, the pH of the composition is from about 6 to about 14, preferably from about 7 to about 12, or more preferably from about 7.5 to about 10, as measured at 10 times dilution in distilled water at 20° C. The pH of the composition can be adjusted using pH modifying ingredients known in the art.

The composition of the present invention can be Newtonian or non-Newtonian, preferably Newtonian. Preferably, the composition has an initial viscosity of from 10 mPa·s to 10,000 mPa·s, preferably from 100 mPa·s to 5,000 mPa·s, more preferably from 300 mPa·s to 2,000 mPa·s, or most preferably from 500 mPa·s to 1,500 mPa·s, alternatively combinations thereof. Viscosity is measured with a Brookfield RT Viscometer using spindle 21 at 20 RPM at 25° C.

The cleaning composition of the invention is especially suitable for use as a hand dishwashing detergent. Due to its desirable sudsing profile, it is extremely suitable for use in its neat form applied directly on a cleaning implement or in diluted form in a full sink of water to wash dishes.

Surfactant System

The cleaning composition comprises from about 1% to about 60%, preferably from about 5% to about 50%, more preferably from about 8% to about 45%, most preferably from about 15% to about 40%, by weight of the total composition of a surfactant system.

Anionic Surfactant

Preferably, the surfactant system for the cleaning composition of the present invention comprises from about 60% to about 90%, preferably from about 65% to 85%, more preferably from about 70% to about 80%, by weight of the surfactant system of an anionic surfactant or mixtures thereof. The surfactant system can be a single surfactant but usually it is a mixture of anionic surfactants. The surfactant system of the composition of the present invention comprises an anionic surfactant selected from sulfate anionic surfactant, preferably alkyl sulfate, alkyl alkoxy sulfate preferably alkyl ethoxy sulfate, or mixtures thereof, wherein the anionic surfactant has a weight average degree of alkyl branching between 41% and 50%. This level of branching contributes to enhanced suds longevity of the composition. It also contributes to the stability of the detergent. Preferably, the average alkyl chain length of the anionic surfactant is from 8 to 18, preferably from 10 to 14, more preferably from 12 to 14, most preferably from 12 to 13 carbons. Preferably, alkyl alkoxy sulfates for use herein are alkyl ethoxy sulfate having an average degree of ethoxylation of less than 5, preferably less than 3, more preferably less than 2 and more than 0.5, most preferably between 0.5 and 0.9. Most preferably, the anionic surfactant is an alkyl ethoxy sulfate anionic surfactant having a mol average alkyl carbon chain length between 12 and 13, a mol average degree of ethoxylation of between 0.5 and 0.9 and a weight average degree of alkyl branching between 41% and 50%. Detergents having this ratio present good suds volume building performance.

When the alkyl ethoxylated sulfate anionic surfactant is a mixture, the average alkoxylation degree is the mol average alkoxylation degree of all the components of the mixture (i.e., mol average alkoxylation degree). In the mol average alkoxylation degree calculation the weight of sulfate anionic surfactant components not having alkoxylate groups should also be included.

$$\text{Mol average alkoxylation degree}=(x1*\text{alkoxylation degree of surfactant } 1+x2*\text{alkoxylation degree of surfactant } 2+\ldots)/(x1+x2+\ldots)$$

wherein x1, x2, . . . are the number of moles of each sulfate anionic surfactant of the mixture and alkoxylation degree is the number of alkoxy groups in each sulfate anionic surfactant.

If the surfactant is branched, the preferred branching group is an alkyl. Typically, the alkyl is selected from methyl, ethyl, propyl, butyl, pentyl, cyclic alkyl groups and mixtures thereof. Single or multiple alkyl branches could be present on the main hydrocarbyl chain of the starting alcohol(s) used to produce the sulfate anionic surfactant used in the composition of the invention.

The branched sulfate anionic surfactant can be a single anionic surfactant or a mixture of anionic surfactants. In the case of a single surfactant the percentage of branching refers to the weight percentage of the hydrocarbyl chains that are branched in the original alcohol from which the surfactant is derived.

In the case of a surfactant mixture the percentage of branching is the weight average and it is defined according to the following formula:

$$\text{Weight average of branching (\%)}=[(x1*\text{wt \% branched alcohol 1 in alcohol } 1+x2*\text{wt \% branched alcohol 2 in alcohol } 2+\ldots)/(x1+x2+\ldots)]*100$$

wherein x1, x2, are the weight in grams of each alcohol in the total alcohol mixture of the alcohols which were used as starting material for the anionic surfactant for the detergent of the invention. In the weight average branching degree calculation, the weight of anionic surfactant components not having branched groups should also be included.

Suitable counterions include alkali metal cation earth alkali metal cation, alkanolammonium or ammonium or substituted ammonium, but preferably sodium.

Suitable examples of commercially available sulfates include, those based on Neodol alcohols ex the Shell company, Lial—Isalchem and Safol® ex the Sasol company, natural alcohols ex The Procter & Gamble Chemicals company.

The anionic surfactant system may further comprise a sulfonate or a sulfosuccinate anionic surfactant. Suitable sulfonate surfactants for use herein include water-soluble salts of C8-C18 alkyl or hydroxyalkyl sulfonates; C11-C18 alkyl benzene sulfonates (LAS), modified alkylbenzene sulfonate (MLAS); methyl ester sulfonate (MES); and alpha-olefin sulfonate (AOS). Those also include the paraffin sulfonates may be monosulfonates and/or disulfonates, obtained by sulfonating paraffins of 10 to 20 carbon atoms.

The sulfonate surfactant also include the alkyl glyceryl sulfonate surfactants. The anionic surfactant may also further comprise a soap, i.e., fatty carboxylate anionic surfactant. Preferably, the anionic surfactant does not further comprise a non-sulfate anionic surfactant.

Primary Co-Surfactant

The surfactant system of the composition of the present invention further comprises a primary co-surfactant. The composition preferably comprises from 0.1% to 20%, more preferably from 0.5% to 15% and especially preferably from 2% to 10%, by weight of the composition of the primary co-surfactant. The primary co-surfactant is selected from the group consisting of an amphoteric surfactant, a zwitterionic surfactant, and mixtures thereof. The composition of the present invention will preferably comprise an amine oxide as the amphoteric surfactant or betaine as the zwitterionic surfactant, or a mixture of said amine oxide and betaine surfactants. Preferably, the amphoteric and the zwitterionic surfactant are in a weight ratio of from about 2:1 to about 1:2. Most preferably the primary co-surfactant is an amine oxide surfactant selected from the group consisting of a linear or branched alkyl amine oxide surfactant, a linear or branched alkyl amidopropyl amine oxide surfactant, and mixtures thereof, preferably a linear alkyl dimethyl amine oxide surfactant, more preferably a linear C10 alkyl dimethyl amine oxide surfactant, a linear C12-C14 alkyl dimethyl amine oxide surfactant, or mixtures thereof, most preferably a linear C12-C14 alkyl dimethyl amine oxide surfactant.

Preferably, the amine oxide surfactant is alkyl dimethyl amine oxide or alkyl amido propyl dimethyl amine oxide, preferably alkyl dimethyl amine oxide and especially coco dimethyl amino oxide, most preferably C12-C14 alkyl dimethyl amine oxide. Typical linear amine oxides include water-soluble amine oxides containing one R1 C8-18 alkyl moiety and 2 R2 and R3 moieties selected from the group consisting of C1-3 alkyl groups and C1-3 hydroxyalkyl groups. Preferably amine oxide is characterized by the formula R1-N(R2)(R3) O wherein R1 is a C8-18 alkyl and R2 and R3 are selected from the group consisting of methyl, ethyl, propyl, isopropyl, 2-hydroxethyl, 2-hydroxypropyl and 3-hydroxypropyl. The linear amine oxide surfactants in particular may include linear C10-C18 alkyl dimethyl amine oxides and linear C8-C12 alkoxy ethyl dihydroxy ethyl amine oxides. Preferred amine oxides include linear C10, linear C10-C12, and linear C12-C14 alkyl dimethyl amine oxides. As used herein "mid-branched" means that the amine oxide has one alkyl moiety having n1 carbon atoms with one alkyl branch on the alkyl moiety having n2 carbon atoms. The alkyl branch is located on the α carbon from the nitrogen on the alkyl moiety. This type of branching for the amine oxide is also known in the art as an internal amine oxide. The total sum of n1 and n2 is from 10 to 24 carbon atoms, preferably from 12 to 20, and more preferably from 10 to 16. The number of carbon atoms for the one alkyl moiety (n1) should be approximately the same number of carbon atoms as the one alkyl branch (n2) such that the one alkyl moiety and the one alkyl branch are symmetric. As used herein "symmetric" means that |n1-n2| is less than or equal to 5, preferably 4, most preferably from 0 to 4 carbon atoms in at least 50 wt %, more preferably at least 75 wt % to 100 wt % of the mid-branched amine oxides for use herein. The amine oxide further comprises two moieties, independently selected from a C1-3 alkyl, a C1-3 hydroxyalkyl group, or a polyethylene oxide group containing an average of from about 1 to about 3 ethylene oxide groups. Preferably, the two moieties are selected from a C1-3 alkyl, more preferably both are selected as a C1 alkyl.

Alternatively, the amine oxide surfactant is a mixture of amine oxides comprising a low-cut amine oxide and a mid-cut amine oxide. The amine oxide of the composition of the invention then comprises:

a) from about 10% to about 45% by weight of the amine oxide of low-cut amine oxide of formula R1R2R3AO wherein R1 and R2 are independently selected from hydrogen, C1-C4 alkyls or mixtures thereof, and R3 is selected from C10 alkyls or mixtures thereof; and b) from 55% to 90% by weight of the amine oxide of mid-cut amine oxide of formula R4R5R6AO wherein R4 and R5 are independently selected from hydrogen, C1-C4 alkyls or mixtures thereof, and R6 is selected from C12-C16 alkyls or mixtures thereof.

In a preferred low-cut amine oxide for use herein R3 is n-decyl. In another preferred low-cut amine oxide for use herein R1 and R2 are both methyl. In an especially preferred low-cut amine oxide for use herein R1 and R2 are both methyl and R3 is n-decyl.

Preferably, the amine oxide comprises less than about 5%, more preferably less than 3%, by weight of the amine oxide of an amine oxide of formula R7R8R9AO wherein R7 and R8 are selected from hydrogen, C1-C4 alkyls and mixtures thereof and wherein R9 is selected from C8 alkyls and mixtures thereof. Compositions comprising R7R8R9AO tend to be unstable and do not provide very suds mileage.

Suitable betaine surfactant includes alkyl betaines, alkylamidobetaine, amidazoliniumbetaine, sulfobetaine (INCI Sultaines) as well as the Phosphobetaine and preferably meets Formula (I):

$$R^1—[CO—X(CH_2)_n]_x—N^+(R^2)(R_3)—(CH_2)_m—[CH(OH)—CH_2]_y—Y— \quad (I)$$

wherein

R1 is a saturated or unsaturated C6-22 alkyl residue, preferably C8-18 alkyl residue, in particular a saturated C10-16 alkyl residue, for example a saturated C12-14 alkyl residue;

X is NH, NR4 with C1-4 Alkyl residue R4, O or S;

n is a number from 1 to 10, preferably 2 to 5, in particular 3;

x is 0 or 1, preferably 1;

R2, and R3 are independently a C1-4 alkyl residue, potentially hydroxy substituted such as a hydroxyethyl, preferably a methyl;

m is a number from 1 to 4, in particular 1, 2 or 3;

y is 0 or 1; and

Y is COO, SO3, OPO(OR5)O or P(O)(OR5)O, whereby R5 is a hydrogen atom H or a C1-4 alkyl residue.

Preferred betaines are the alkyl betaines of the Formula (Ia), the alkyl amido propyl betaine of the Formula (Ib), the Sulfo betaines of the Formula (Ic) and the Amido sulfobetaine of the Formula (Id):

$$R^1—N(CH_3)_2—CH_2COO— \quad (Ia)$$

$$R^1—CO—NH(CH_2)_3—N^+(CH_3)_2—CH_2COO— \quad (Ib)$$

$$R^1—N^+(CH_3)_2—CH_2CH(OH)CH_2SO_3— \quad (Ic)$$

$$R^1—CO—NH(CH_2)_3—N^+(CH_3)_2—CH_2CH(OH)CH_2SO_3— \quad (Ib)$$

in which R1 as the same meaning as in Formula (I). Particularly preferred betaines are the Carbobetaine [wherein Y——COO—], in particular the Carbobetaine of the Formulae (Ia) and (lb), more preferred are the Alkylamidobetaine of the Formula (Ib).

Examples of suitable betaines and sulfobetaine are the following [designated in accordance with INCI]: Almondamidopropyl of betaines, Apricotam idopropyl betaines, Avocadamidopropyl of betaines, Babassuamidopropyl of betaines, Behenam idopropyl betaines, Behenyl of betaines, betaines, Canolam idopropyl betaines, Capryl/Capram idopropyl betaines, Carnitine, Cetyl of betaines, Cocamidoethyl of betaines, Cocam idopropyl betaines, Cocam idopropyl Hydroxysultaine, Coco betaines, Coco Hydroxysultaine, Coco/Oleam idopropyl betaines, Coco Sultaine, Decyl of betaines, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl of PG-betaines, Erucam idopropyl Hydroxysultaine, Hydrogenated Tallow of betaines, Isostearam idopropyl betaines, Lauram idopropyl betaines, Lauryl of betaines, Lauryl Hydroxysultaine, Lauryl Sultaine, Milkam idopropyl betaines, Minkamidopropyl of betaines, Myristam idopropyl betaines, Myristyl of betaines, Oleam idopropyl betaines, Oleam idopropyl Hydroxysultaine, Oleyl of betaines, Olivamidopropyl of betaines, Palmam idopropyl betaines, Palm itam idopropyl betaines, Palmitoyl Carnitine, Palm Kernelam idopropyl betaines, Polytetrafluoroethylene Acetoxypropyl of betaines, Ricinoleam idopropyl betaines, Sesam idopropyl betaines, Soyam idopropyl betaines, Stearam idopropyl betaines, Stearyl of betaines, Tallowam idopropyl betaines, Tallowam idopropyl Hydroxysultaine, Tallow of betaines, Tallow Dihydroxyethyl of betaines, Undecylenam idopropyl betaines and Wheat Germam idopropyl betaines.

A preferred betaine is, for example, cocoamidopropylbetaine.

Preferably, the surfactant system of the composition of the present invention comprises an anionic surfactant and a primary co-surfactant and the anionic surfactant to primary co-surfactant weight ratio is from about 1:1 to about 8:1, preferably from about 2:1 to about 5:1, more preferably from 2.5:1 to 4:1. Detergents having this ratio present good suds performance, especially suds volume build up and suds volume retention performance, both when used under full sink as well as under direct application on a cleaning implement consumer wash habits.

Secondary Co-Surfactant

The composition of the invention may comprise a secondary co-surfactant. Preferably the secondary co-surfactant comprises a non-ionic surfactant. Preferably, the non-ionic surfactant is a linear or branched, primary or secondary alkyl alkoxylated non-ionic surfactant, preferably an alkyl ethoxylated non-ionic surfactant, preferably comprising on average from 9 to 15, preferably from 10 to 14 carbon atoms in its alkyl chain and on average from 5 to 12, preferably from 6 to 10, most preferably from 7 to 8, units of ethylene oxide per mole of alcohol. The composition may comprise from 1% to 25%, more preferably from 1.25% to 20%, more preferably from 1.5% to 15%, most preferably from 1.5% to 5%, by weight of the surfactant system of this alkoxylated preferably ethoxylated non-ionic surfactant.

Alternatively, the secondary co-surfactant comprises an alkyl polyglucoside non-ionic surfactant. Preferably, the composition of the present invention further comprises from 0.5% to 20%, more preferably from 0.75% to 15%, more preferably from 1% to 10%, most preferably from 1% to 5% by weight of the surfactant system of alkyl polyglucoside ("APG") surfactant. Preferably the alkyl polyglucoside surfactant is a C8-C16 alkyl polyglucoside surfactant, preferably a C8-C14 alkyl polyglucoside surfactant, preferably with an average degree of polymerization of between 0.1 and 3, more preferably between 0.5 and 2.5, even more preferably between 1 and 2. Most preferably the alkyl polyglucoside surfactant has an average alkyl carbon chain length between 10 and 16, preferably between 10 and 14, most preferably between 12 and 14, with an average degree of polymerization of between 0.5 and 2.5 preferably between 1 and 2, most preferably between 1.2 and 1.6. C8-C16 alkyl polyglucosides are commercially available from several suppliers (e.g., Simusol® surfactants from Seppic Corporation; and Glucopon® 600 CSUP, Glucopon® 650 EC, Glucopon® 600 CSUP/MB, and Glucopon® 650 EC/MB, from BASF Corporation).

The secondary co-surfactant might also comprise a mixture of alcohol alkoxylate preferably ethoxylate and APG non-ionic surfactants.

Preferably, the compositions of the present invention are free or substantially free of cationic surfactant.

Preferably, the surfactant system of the composition of the present invention comprises: (i) from 70% to 80% by weight of the surfactant system of an alkyl ethoxy sulfate; and (ii) from 20% to 30% by weight of the surfactant system of an amine oxide surfactant.

Cyclic Polyamine

The cyclic polyamine of the invention is known as a cleaning polyamine. By "cleaning polyamine" is herein meant a molecule, having the formula depicted herein below, comprising amine functionalities that helps cleaning as part of a cleaning composition.

The Applicant has surprisingly discovered that these cyclic polyamines also work to improve suds profile through-out the dishwashing process when formulated together with a highly branched anionic surfactant according to the present invention. This is especially surprising as the suds benefit, especially retention of suds consistency through-out the wash process, has not been observed within formulations combining the specific cyclic polyamines with lowly branched anionic surfactant systems (see example section), as they have been described previously when targeting cleaning improvements. Accordingly, the composition of the invention comprises from about 0.1% to about 5%, preferably from about 0.1% to 2% by weight of the composition of the cyclic polyamine. The term "cyclic polyamine" herein encompasses a single polyamine and a mixture thereof. The polyamine can be subjected to protonation depending on the pH of the cleaning medium in which it is used.

The cyclic polyamine conforms to Formula (I):

(I)

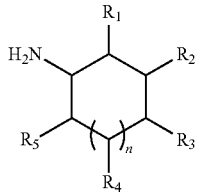

wherein the radicals $R_1$, $R_2$, $R_3$, $R_4$ and $R_5$ are independently selected from NH2, —H, linear or branched alkyl or alkenyl having from 1 to 10 carbon atoms and n is from 1 to 3 and wherein at least one of the radicals is NH2.

Preferably the cyclic polyamine is a diamine, wherein n is 1, R2 is NH2 and at least one of R1, R3, R4 and R5 is CH3 and preferably the remaining radicals are H.

Preferably the cyclic polyamine is a cyclic polyamine with at least two primary amine functionalities. The primary amines can be in any position in the cycle but it has been found that in terms of grease cleaning, better performance is obtained when the primary amines are in positions 1,3. It has also been found advantageous in terms of grease cleaning amines in which one of the substituents is —CH3 and the rest are H.

Especially preferred for use herein are cleaning amines selected from the group consisting of 2-methylcyclohexane-1,3-diamine, 4-methylcyclohexane-1,3-diamine and mixtures thereof.

We surprisingly found that the specific cyclic polyamines, known to provide grease cleaning benefits within detergent formulations, also enabled, when formulated together with highly branched anionic surfactant systems according to the inventions, a better suds mileage, more sustained suds consistency and more sustained suds whiteness during a dishwashing process. This is especially surprising as it was also found that within lowly branched anionic surfactant systems as they have been described into the prior art and outside the scope of the invention, that a less sustained suds consistency was achieved.

Amphiphilic Polymer

The composition of the present invention may further comprise from about 0.01% to about 5%, preferably from about 0.05% to about 2%, more preferably from about 0.07% to about 1%, by weight of the total composition of an amphiphilic polymer selected from the groups consisting of amphiphilic alkoxylated polyalkyleneimine, amphiphilic graft polymer and mixtures thereof, preferably an amphiphilic alkoxylated polyalkyleneimine.

Preferably, the amphiphilic alkoxylated polyalkyleneimine is an alkoxylated polyethyleneimine polymer comprising a polyethyleneimine backbone having average molecular weight range from 100 to 5,000, preferably from 400 to 2,000, more preferably from 400 to 1,000 Daltons and the alkoxylated polyethyleneimine polymer further comprising:

i) one or two alkoxylation modifications per nitrogen atom by a polyalkoxylene chain having an average of about 1 to about 50 alkoxy moieties per modification, wherein the terminal alkoxy moiety of the alkoxylation modification is capped with hydrogen, a C1-C4 alkyl or mixtures thereof;

ii) an addition of one C1-C4 alkyl moiety and one or two alkoxylation modifications per nitrogen atom by a polyalkoxylene chain having an average of about 1 to about 50 alkoxy moieties per modification wherein the terminal alkoxy moiety is capped with hydrogen, a C1-C4 alkyl or mixtures thereof; or iii) a combination thereof; and wherein the alkoxy moieties comprises ethoxy (EO) and/or propoxy (PO) and/or butoxy (BO) and wherein when the alkoxylation modification comprises EO it also comprises PO or BO.

Preferred amphiphilic alkoxylated polyethyleneimine polymers comprise EO and PO groups within their alkoxylation chains, the PO groups preferably being in terminal position of the alkoxy chains, and the alkoxylation chains preferably being hydrogen capped. Hydrophilic alkoxylated polyethyleneimine polymers solely comprising ethoxy (EO) units within the alkoxylation chain could also optionally be formulated within the scope of this invention.

For example, but not limited to, below is shown possible modifications to terminal nitrogen atoms in the polyethyleneimine backbone where R represents an ethylene spacer and E represents a C1-C4 alkyl moiety and X− represents a suitable water soluble counterion.

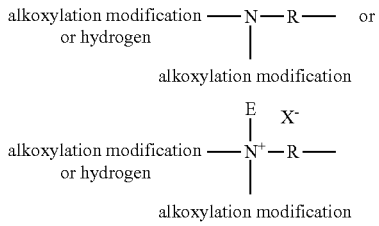

Also, for example, but not limited to, below is shown possible modifications to internal nitrogen atoms in the polyethyleneimine backbone where R represents an ethylene spacer and E represents a $C_1$-$C_4$ alkyl moiety and X− represents a suitable water soluble counterion.

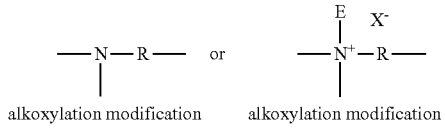

The alkoxylation modification of the polyethyleneimine backbone consists of the replacement of a hydrogen atom by a polyalkoxylene chain having an average of about 1 to about 50 alkoxy moieties, preferably from about 20 to about 45 alkoxy moieties, most preferably from about 30 to about 45 alkoxy moieties. The alkoxy moieties are selected from ethoxy (EO), propoxy (PO), butoxy (BO), and mixtures thereof. Alkoxy moieties solely comprising ethoxy units are outside the scope of the invention though. Preferably, the polyalkoxylene chain is selected from ethoxy/propoxy block moieties. More preferably, the polyalkoxylene chain is ethoxy/propoxy block moieties having an average degree of ethoxylation from about 3 to about 30 and an average degree of propoxylation from about 1 to about 20, more preferably ethoxy/propoxy block moieties having an average degree of ethoxylation from about 20 to about 30 and an average degree of propoxylation from about 10 to about 20.

More preferably the ethoxy/propoxy block moieties have a relative ethoxy to propoxy unit ratio between 3 to 1 and 1 to 1, preferably between 2 to 1 and 1 to 1. Most preferably the polyalkoxylene chain is the ethoxy/propoxy block moieties wherein the propoxy moiety block is the terminal alkoxy moiety block.

The modification may result in permanent quaternization of the polyethyleneimine backbone nitrogen atoms. The degree of permanent quaternization may be from 0% to about 30% of the polyethyleneimine backbone nitrogen atoms. It is preferred to have less than 30% of the polyethyleneimine backbone nitrogen atoms permanently quaternized. Most preferably the degree of quaternization is about 0%.

A preferred polyethyleneimine has the general structure of Formula (II):

(II)

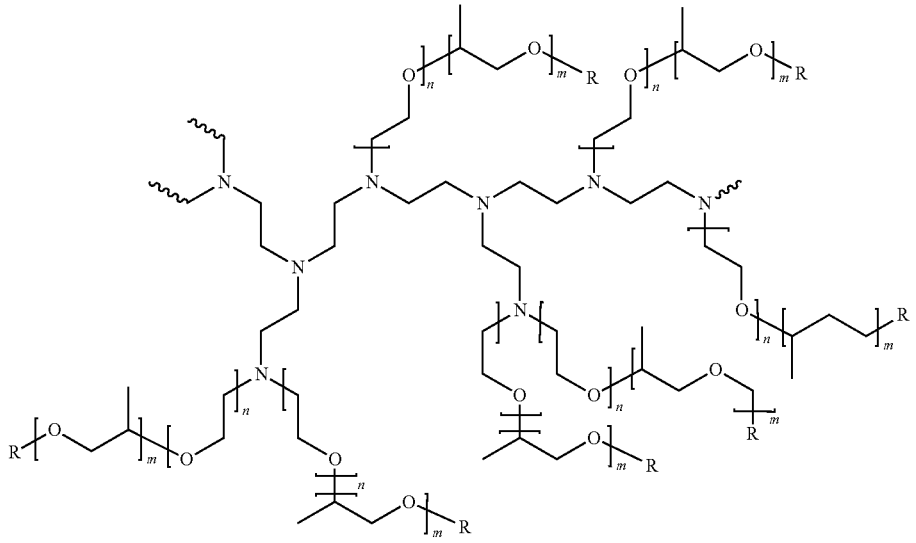

wherein the polyethyleneimine backbone has a weight average molecular weight of about 600, n of Formula (II) has an average of about 10, m of Formula (II) has an average of about 7 and R of Formula (II) is selected from hydrogen, a $C_1$-$C_4$ alkyl and mixtures thereof, preferably hydrogen. The degree of permanent quaternization of Formula (II) may be from 0% to about 22% of the polyethyleneimine backbone nitrogen atoms. The molecular weight of this polyethyleneimine preferably is between 10,000 and 15,000.

An alternative polyethyleneimine has the general structure of Formula (II) but wherein the polyethyleneimine backbone has a weight average molecular weight of about 600, n of formula (I) has an average of about 24, m of Formula (II) has an average of about 16 and R of formula (I) is selected from hydrogen, a $C_1$-$C_4$ alkyl and mixtures thereof, preferably hydrogen. The degree of permanent quaternization of Formula (II) may be from 0% to about 22% of the polyethyleneimine backbone nitrogen atoms. The molecular weight of this polyethyleneimine preferably is between 25,000 and 30,000.

Most preferred polyethyleneimine has the general structure of Formula (II) wherein the polyethyleneimine backbone has a weight average molecular weight of about 600, n of Formula (II) has an average of about 24, m of Formula (II)) has an average of about 16 and R of Formula (II) is hydrogen. The degree of permanent quaternization of Formula (II) is 0% of the polyethyleneimine backbone nitrogen atoms. The molecular weight of this polyethyleneimine preferably is about from about 25,000 to 30,000, most preferably about 28,000.

These polyethyleneimines can be prepared, for example, by polymerizing ethyleneimine in the presence of a catalyst such as carbon dioxide, sodium bisulfite, sulfuric acid, hydrogen peroxide, hydrochloric acid, acetic acid, and the like, as described in more detail in PCT Publication No. WO 2007/135645.

The composition of the present invention may further comprise at least one active selected from the group consisting of: i) a salt, ii) a hydrotrope, iii) an organic solvent, and mixtures thereof.

Salt

The composition of the present invention may further comprise from about 0.05% to about 2%, preferably from about 0.2% to about 1.5%, or more preferably from about 0.5% to about 1%, by weight of the total composition of a salt, preferably a monovalent, divalent inorganic salt or a mixture thereof, more preferably sodium chloride, sodium sulphate or a mixture thereof, most preferably sodium chloride.

Hydrotrope

The composition of the present invention may further comprise from about 0.1% to about 10%, or preferably from about 0.5% to about 10%, or more preferably from about 1% to about 6%, by weight of the total composition of a hydrotrope or a mixture thereof, preferably sodium cumene sulfonate.

Organic Solvent

The composition of the present invention may further comprise an organic solvent. Suitable organic solvents include C4-14 ethers and diethers, polyols, glycols, alkoxylated glycols, C6-C16 glycol ethers, alkoxylated aromatic alcohols, aromatic alcohols, aliphatic linear or branched alcohols, alkoxylated aliphatic linear or branched alcohols, alkoxylated C1-C5 alcohols, C8-C14 alkyl and cycloalkyl hydrocarbons and halohydrocarbons, and mixtures thereof. Preferably the organic solvents include alcohols, glycols, and glycol ethers, alternatively alcohols and glycols. The composition comprises from 0% to less than about 50%, preferably from about 0.01% to about 25%, more preferably from about 0.1% to about 10%, or most preferably from about 0.5% to about 5%, by weight of the total composition of an organic solvent, preferably an alcohol, more preferably ethanol, a polyalkyleneglycol more preferably polypropyleneglycol, and mixtures thereof.

Adjunct Ingredients

The cleaning composition herein may optionally comprise a number of other adjunct ingredients such as builders (e.g., preferably citrate), chelants, conditioning polymers, cleaning polymers, surface modifying polymers, soil flocculating polymers, structurants, emollients, humectants, skin rejuvenating actives, enzymes, carboxylic acids, scrubbing particles, bleach and bleach activators, perfumes, malodor control agents, pigments, dyes, opacifiers, beads, pearlescent particles, microcapsules, inorganic cations such as alkaline earth metals such as Ca/Mg-ions, antibacterial agents, preservatives, viscosity adjusters (e.g., salt such as NaCl, and other mono-, di- and trivalent salts) and pH adjusters and buffering means (e.g. carboxylic acids such as citric acid, HCl, NaOH, KOH, alkanolamines, phosphoric and sulfonic acids, carbonates such as sodium carbonates, bicarbonates, sesquicarbonates, borates, silicates, phosphates, imidazole and alike).

The elements of the composition of the invention described in connexion with the first aspect of the invention apply mutatis mutandis to the other aspects of the invention.

Method of Washing

In another aspect, the invention is directed to a method of manually washing dishware with the composition of the present invention. The method comprises the steps of delivering a composition of the present invention onto the soiled dishware or cleaning implement, cleaning the dishware with the composition in the presence of water, and optionally rinsing the dishware. By "rinsing", it is meant herein contacting the dishware cleaned with the process according to the present invention with substantial quantities of appropriate solvent, typically water. By "substantial quantities", it is meant usually about 1 L to about 20 L. The composition can be pre-dissolved in a sink of water to create an aqueous washing solution and the soiled dishware is immersed in the aqueous washing solution. The dishware can be subsequently rinsed.

The composition herein can be applied in its diluted form. Soiled dishware are contacted with an effective amount, typically from about 0.5 mL to about 20 mL (per about 25 dishes being treated), preferably from about 3 mL to about 10 mL, of the cleaning composition, preferably in liquid form, of the present invention diluted in water. The actual amount of cleaning composition used will be based on the judgment of the user, and will typically depend upon factors such as the particular product formulation of the cleaning composition, including the concentration of active ingredients in the cleaning composition, the number of soiled dishes to be cleaned, the degree of soiling on the dishes, and the like. Generally, from about 0.01 mL to about 150 mL, preferably from about 3 mL to about 40 mL of a cleaning composition of the invention is combined with from about 2,000 mL to about 20,000 mL, more typically from about 5,000 mL to about 15,000 mL of water in a sink having a volumetric capacity in the range of from about 1,000 mL to about 20,000 mL, more typically from about 5,000 mL to about 15,000 mL. The soiled dishware are immersed in the sink containing the diluted cleaning compositions then obtained, where contacting the soiled surface of the dishware with a cloth, sponge, or similar cleaning implement cleans them. The cloth, sponge, or similar cleaning implement may be immersed in the cleaning composition and water mixture prior to being contacted with the dishware, and is typically contacted with the dishware for a period of time ranged from about 1 seconds to about 10 seconds, although the actual time will vary with each application and user. The contacting of cloth, sponge, or similar cleaning implement to the dishware is preferably accompanied by a concurrent scrubbing of the dishware.

Alternatively the neat dishwashing detergent product can also be applied directly on the dishware, or more preferably directly on an optionally but preferably pre-wetted cleaning implement, preferably a pre-wetted sponge. Typically between 0.1 mL and 25 mL, rather between 1 mL and 10 mL of the dishwashing detergent product is dosed by the consumer on the sponge. This pre-wetted detergent carrying sponge is consequently contacted with optionally pre-wetted dishware to be cleaned. The cleaning action can be performed under a tap of running water such that applied detergent and removed soil can be rinsed off the dishware. Alternatively, the cleaning action can be done without running water, followed by a consequent rinsing step to remove the applied detergent and soil from the dishware. Within this method of the present invention the dissolution of the composition with water in this cleaning implement, preferably a sponge, will be delayed such that the cleaning product is solely gradually released, characterized by the composition having a decrease in viscosity of less than 85%, preferably less than 80%, more preferably less than 75%, most preferably between 65% and 75%, based on the initial viscosity of the composition at 60% product concentration in demineralized water at 20° C.

Another aspect of the present invention is directed to use of a hand dishwashing cleaning composition of the present invention for providing good sudsing profile, more particularly at least one of sustained suds volume, sustained suds consistency and sustained suds whiteness through-out the wash process. Preferably, the use is applicable under full sink washing condition and direct application of product on cleaning implement and washing under tap.

Test Methods

The following assays set forth must be used in order that the invention described and claimed herein may be more fully understood.

Test Method 1: Suds Rheology Test

The suds rheology test aims at measuring physical characteristics of suds, representative for suds consistency and overall consumer acceptability of the suds generated from a detergent composition when applied and agitated on a sponge through manual squeezing action.

When measuring the suds rheology for different product concentrations, the sustainability of suds aesthetics for the product upon dilution with wash water through-out the wash process is also determined. The test is conducted by the following steps:

1. For each test product, 30 g of aqueous wash solutions (15 dH water hardness, 20° C.) of the targeted product concentrations (e.g., 10%, 1%) are prepared.
2. Synthetic dishwashing sponges (Brand: Delhaize Belgium scour sponges with grip—dimensions: length 9.5 cm, width 6.5 cm and height 4.5 cm, item number 17152/0000) are pre-conditioned by washing them without detergent during 3 cycles of 32 mins at 40° C. and 15 dH water hardness in a laundry washing machine (Brand: Miele Softronic W3205—Express cycle).
3. The washed sponges are left to dry for 2 days under a fume food (Brand: Kötermann type 2-453-GAHB) with air flow 0.64 msec under standard lab conditions (e.g., 20-22° C., 40-60% rH).
4. The respective 30 g wash solution is distributed homogeneously over the soft side opposite to the scouring side of the dry sponge, allowing the wash solution to completely submerge into the sponge for 20 seconds.
5. While wearing latex lab gloves and while holding the scouring side down, the sponge is manually squeezed 5 times with maximum power (i.e., frequency 1 squeeze per second) after which the generated suds on the sponge is collected in a cup and transferred with a spatula onto the serrated peltier plate of the rheometer (TA Rheometer DHR1) such that the entire serrated peltier plate surface is covered with suds.

6. The suds rheology is measured with a serrated parallel plate (both top and bottom serrated geometry) at a gap of 1000 μm and following a peak hold procedure at 20° C., at shear rate l/s with a duration of 300 seconds measuring 600 data points (Stress constant=79577.5 Pa/N·m, Strain constant=20 l/rad). The value measured after 1 second is reported as the static yield stress.
7. 3 replicates are run for each test product at each product concentration and the measured static yield stress values are averaged per product and per product concentration. For each product concentration and replicate, a new dry sponge is used and all tests are run by the same expert operator.

The Δ Yield Stress between 2 different product concentrations is calculated by subtracting the Static Yield Stress value of the lower product concentration from the Static Yield Stress value of the higher product concentration, according to the formula described below:

Δ Yield Stress ($X$ %−$Y$ %)=Static Yield Stress at $X$ % product concentration−Static Yield Stress at $Y$ % product concentration Test Method 2: Suds Mileage Test The evolution of the suds volume generated by a certain solution of dishwashing liquid is followed at specified water hardness, solution temperature and detergent concentrations, under influence of periodic soil injections. Data are compared and expressed versus a reference product as a suds mileage index (reference product has suds mileage index of 100).

A defined amount of dishwashing product depending on the targeted detergent concentration (typically 0.12% unless mentioned otherwise) is dispensed through a pipet with a flow rate of 0.67 mL/sec at a height of 37 cm above the sink bottom surface into a water stream that starts filling up a sink (dimensions: cylinder−diameter 300 mm & height 288 mm) to 4 L with a constant pressure of 4 bar. With this pressure an initial suds volume is generated in the sink.

After recording the initial suds volume (average suds height*sink surface area) a fixed amount of soil (6 mL—composition: see Table 1 below) will be injected almost instantaneously in the middle of the sink, while a paddle (metal blade 10×5 cm, positioned in the middle of the sink at the air liquid interface under an angle of 45 degrees) will rotate 20 times into the solution at 85 RPM. This step is followed immediately by another measurement of the total suds volume. The soil injecting, paddling and measuring steps are repeated until the measured suds volume reaches a minimum level, which is set at 400 $cm^3$. The amount of soil additions needed to get to that level is considered as the mileage of that specific sample.

The complete process is repeated 4 times per sample and per testing condition (temperature−water hardness combination). As a final result, the average mileage of the 4 replicates is calculated for each sample. Comparing the average mileage of the test sample versus that of the reference sample, indicates the performance of the test sample versus that reference sample, and is expressed as a suds mileage index, calculated as (average number of soil additions of test sample/average number of soil additions of reference sample)*100 (i.e., the higher the better suds mileage).

TABLE 1

Soil Composition

| Ingredient | Weight % |
|---|---|
| Crisco oil | 12.730% |
| Crisco shortening | 27.752% |
| Lard | 7.638% |
| Refined Rendered Edible Beef Tallow | 51.684% |
| Oleic Acid, 90% | 0.139% |
| Palmitic Acid, 99+% | 0.036% |
| Stearic Acid, 99+% | 0.021% |

Test Method 3: Grease Emulsification Test

The ability of a test composition to emulsify and prevent re-deposition of a greasy soil in a wash solution is assessed by dissolving the test formulations at a 0.3% product concentration in water (35° C. temperature—2 dH water hardness). 300 mL of the aqueous wash solution is added together with 30 mL of greasy soil (Consumer Average Beef Fat "CABF" cooking shortening—J & R Coordinating Services, Inc.—composition: see table 2)/Olive oil ("Extra olijfolie van de eerste persing uit Spanje"—Carrefour Belgium)—mixture at 30/70 ratio and further comprising 0.1 wt % of a visualizing red dye pigment (Waxoline Red YP FW from Avecia), to a white plastic container (dimensions: 14 cm*14 cm*6 cm—Fresh & Go 0.5 l/Curver), and manually shaken for 8 minutes at a frequency of 100 shakes a minute (one shake=one 10 cm up and one 10 cm down movement). The relative whiteness of the inside cover of the plastic container is visually compared directly after shaking between a comparative composition and a test composition which are shaken together to ensure the same agitation has been applied.

TABLE 2

CABF Soil Composition

| Ingredient | Weight (g) |
|---|---|
| Refined Rendered Edible Beef Tallow (Bunge Oils) | 1989.8 g |
| Oleic acid (90%) (Sigma Aldrich) | 4.8 g |
| Palmitic acid (100%) (Sigma Aldrich) | 3.7 g |
| Stearic Acid (100%) | 1.7 g |
| Total | 2000 g |

EXAMPLE

The following examples are provided to further illustrate the present invention and are not to be construed as limitations of the present invention, as many variations of the present invention are possible without departing from its spirit or scope.

Example 1: Cyclic Polyamines Compositions Impact on Suds Consistency

Inventive Composition 1 is an example of cleaning compositions according to the present invention, made with the specific cyclic polyamine (available as Baxxodur™ ECX210 from BASF) and a highly branched anionic surfactant. Comparative Compositions 1, 2A, 2B and 3 to 5 are reference compositions containing an alkyl ethoxy sulfate surfactant with varying average alkyl branching degree outside the scope of the invention and/or in the absence of the specific cyclic polyamine. The compositions are summarized below in Table 3 and are produced by standard mixing of the components disclosed therein with the ethanol and PPG levels adjusted to ensure all the formulae have the similar viscosity to allow for single variable comparison.

TABLE 3

| Inventive and Comparative Compositions | | | | | | | |
|---|---|---|---|---|---|---|---|
| Ingredients (wt % as 100% active) | Inventive Comp. 1 | Comparative Comp. 1 | Comparative Comp. 2A | Comparative Comp. 2B | Comparative Comp. 3 | Comparative Comp. 4 | Comparative Comp. 5 |
| Surfactants | | | | | | | |
| C1213AE0.6S (20.96% branching) | — | 20.2 | — | 20.2 | — | — | — |
| C1213AE0.7S (42.02% branching) | 20.2 | — | — | — | 20.2 | — | — |
| C1213AE0.6S (55.00% branching) | — | — | 20.2 | — | — | 20.2 | — |
| C1213AE0.6S (33.44% branching) | — | — | — | — | — | — | 20.2 |
| C1214 alkyl dimethyl amine oxide | 6.7 | 6.7 | 6.7 | 6.7 | 6.7 | 6.7 | 6.7 |
| Performance additives | | | | | | | |
| Baxxodur ™ ECX210* | 0.9 | — | 0.9 | 1 | — | — | — |
| Alkoxylated polyethyleneimine (PEI600EO24PO16) | 0.23 | 0.23 | 0.23 | 0.23 | 0.23 | 0.23 | 0.23 |
| Solvents (viscosity trimming) | | | | | | | |
| ethanol | 1 | 1.5 | 1 | 1 | 1 | 1 | 2.6 |
| Polypropyleneglycol (MW2000) | 0.2 | 1.1 | 0.2 | 0.5 | 0.75 | 0.4 | 0.6 |
| Electrolyte | | | | | | | |
| NaCl | 0.9 | 0.9 | 0.9 | 0.9 | 0.9 | 0.9 | 0.9 |
| Balance | | | | | | | |
| Water and minors (dye, perfume, preservative) | To 100% | To 100% | To 100% | To 100% | To 100% | To 100% | To 100% |
| Physical characteristics | | | | | | | |
| pH (through NaOH trimming) | 9.0 | 9.0 | 9.0 | 9.0 | 9.0 | 9.0 | 9.0 |

*Baxxodur ™ ECX210: mixture of 4-methylcyclohexane-1,3-diamine and 2-methylcyclohexane-1,3-diamine, available from BASF.

Results:

The impact of the addition of Baxxodur™ ECX210 cyclic polyamine according to the invention on formulae comprising an average degree of AES branching outside the scope of the invention (55%—Comparative Composition 2A and 21%—Comparative Composition 2B) and inside the scope the invention (42%—Inventive Composition 1) have been assessed for suds consistency following the protocol described herein. The A Yield Stress for the tested compositions are shown in Table 4 below.

From the data it can clearly be seen that addition of the cyclic polyamine according to the invention on top of an AES branching within the scope of the invention (42%) improves the suds consistency upon dilution (lower delta 10-1 value), contrary to when added on top of an AES branching outside the scope of the invention (21%; 55%) where the suds consistency profile got worsened (higher delta 10-1 value).

TABLE 4

| Delta Yield Stress | | | | | | |
|---|---|---|---|---|---|---|
| | 21% AES branching | | 42% AES branching | | 55% AES branching | |
| | Nil Baxxodur ™ ECX210 | 1% Baxxodur ™ ECX210 | Nil Baxxodur ™ ECX210 | 0.9% Baxxodur ™ ECX210 | Nil Baxxodur ™ ECX210 | 0.9% Baxxodur ™ ECX210 |
| 10% yield stress | 13.3 | 13.8 | 14.6 | 14.2 | 14.2 | 15.9 |
| 1% yield stress | 10.9 | 10.7 | 11.7 | 12.8 | 10.9 | 13.1 |
| Delta 10-1 | 2.4 | 3.1 | 2.9 | 1.4 | 3.3 | 2.8 |

TABLE 4-continued

| | Delta Yield Stress | | | | | |
|---|---|---|---|---|---|---|
| | 21% AES branching | | 42% AES branching | | 55% AES branching | |
| | Nil Baxxodur ™ ECX210 | 1% Baxxodur ™ ECX210 | Nil Baxxodur ™ ECX210 | 0.9% Baxxodur ™ ECX210 | Nil Baxxodur ™ ECX210 | 0.9% Baxxodur ™ ECX210 |
| Delta (Baxxodur ECX210 − nil Baxxodur ECX210) | +0.7 | | −1.5 | | −0.5 | |

Example 2: Cyclic Polyamines Compositions Impact on Suds Mileage

The impact of addition of Baxxodur™ ECX210 cyclic polyamine according to the invention on formulae comprising a weight average degree of AES branching outside the scope of the invention (55%—Comparative Composition 2A and 21%—Comparative Composition 2B) and inside the scope the invention (42%—Inventive Composition 1) have been assessed for suds mileage following the protocol described herein. The suds mileage data for the tested compositions are shown in Table 5 below.

Results:

From the data it can clearly be seen that addition of the cyclic diamine according to the invention on top of a dishwashing composition increases the suds mileage profile, and that this increase is more pronounced when added on top of an AES branching within the scope of the invention compared to when added on top of an AES branching outside the scope of the invention.

TABLE 5

| | Suds Mileage Data | | | | | |
|---|---|---|---|---|---|---|
| | 21% branching | | 42% branching | | 55% branching | |
| Test Condition | Nil Baxxodur ™ ECX210 | 1% Baxxodur ™ ECX210 | Nil Baxxodur ™ ECX210 | 0.9% Baxxodur ™ ECX210 | Nil Baxxodur ™ ECX210 | 0.9% Baxxodur ™ ECX210 |
| 35 degrees - 2dH | 100 | 107 | 113 | 130 | 110 | 121 |

Example 3: Cyclic Polyamines Compositions Impact on Grease Re-Deposition

A test composition comprising Baxxodur™ ECX210 cyclic polyamine and an average AES branching degree according to the invention (42%—Inventive Composition 1) has been compared with a comparative composition not comprising a cyclic polyamine according to the invention and comprising a weight average degree of AES branching outside the scope of the invention (33.44%—Comparative Composition 5) for their ability to prevent grease re-deposition through-out the washing process following the Grease Emulsification Test protocol described herein.

Results:

The resulting tub covers are shown in FIG. 1. It can clearly be seen that considerably less grease has been re-deposited, evidenced by much whiter tub cover, with the test composition according to the invention (Inventive Composition 1) compared with the comparative composition outside the scope of the invention (Comparative Composition 5).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A hand dishwashing cleaning composition comprising from about 1% to about 60% by weight of the total composition of a surfactant system, and from about 0.1% to about 5% by weight of the composition of a cyclic polyamine, and from about 50% to about 85% water, wherein:

A) the surfactant system comprises:

i) from about 73% to about 90% by weight of the surfactant system of an anionic surfactant, wherein the anionic surfactant comprises an alkyl sulfate, an alkyl alkoxy sulfate or mixtures thereof; and wherein the anionic surfactant has a weight average degree of alkyl branching between 41% and 50%; and ii) from about 0.1% to about 20% by weight of the composition of a primary co-surfactant, wherein the primary co-surfactant is selected from the group consisting of an amine oxide surfactant, a betaine surfactant, and mixtures thereof; and B) the cyclic polyamine is a cyclic polyamine of Formula (I):

(I)

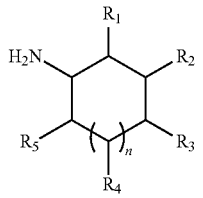

wherein the radicals $R_1$, $R_2$, $R_3$, $R_4$ and $R_5$ are independently selected from NH2, —H, linear or branched alkyl or alkenyl having from 1 to 10 carbon atoms and n is from 1 to 3 and wherein at least one of the radicals is NH2.

2. The composition according to claim 1, wherein the cyclic polyamine is a diamine, wherein n is 1, R2 is NH2 and at least one of R1, R3, R4 and R5 is CH3 and the remaining radicals are H.

3. The composition according to claim 2, wherein the cyclic polyamine is selected from the group consisting of 2-methylcyclohexane-1,3-diamine, 4-methylcyclohexane-1,3-diamine, and mixtures thereof.

4. The composition according to claim 1, wherein the anionic surfactant comprises an alkyl ethoxy sulfate or a mixture of an alkyl sulfate and an alkyl ethoxy sulfate, having an average degree of ethoxylation of less than about 5, and wherein the average alkyl chain length of the anionic surfactant is from about 8 to about 18 carbons.

5. The composition according to claim 1, wherein the primary co-surfactant is an amine oxide surfactant selected from the group consisting of a linear or branched alkyl amine oxide surfactant, a linear or branched alkyl amidopropyl amine oxide surfactant, and mixtures thereof.

6. The composition according to claim 5, wherein the amine oxide surfactant is a linear alkyl dimethyl amine oxide surfactant selected from a linear C10 alkyl dimethyl amine oxide surfactant, a linear C12-C14 alkyl dimethyl amine oxide surfactant, or mixtures thereof.

7. The composition according to claim 1, wherein the weight ratio of the anionic surfactant and the primary co-surfactant is from about 1:1 to about 8:1.

8. The composition according to claim 7, wherein the weight ratio of the anionic surfactant and the primary co-surfactant is from about 2:1 to about 5:1.

9. The composition according to claim 1, wherein the surfactant system further comprises from about 1% to about 25% by weight of the surfactant system of a secondary co-surfactant comprising a non-ionic surfactant.

10. The composition according to claim 9, wherein the non-ionic surfactant is an alkyl ethoxylated non-ionic surfactant comprising from about 9 to about 15 carbon atoms in its alkyl chain and from about 5 to about 12 units of ethylene oxide per mole of alcohol.

11. The composition according to claim 9, wherein the surfactant system comprises from about 0.5% to about 20% by weight of the surfactant system of the non-ionic surfactant, wherein the non-ionic surfactant is an alkyl polyglucoside surfactant, wherein the alkyl polyglucoside surfactant is a C8-C16 alkyl polyglucoside surfactant, with an average degree of polymerization of between about 0.1 and about 3.

12. The composition according to claim 11, wherein the alkyl polyglucoside surfactant is a C8-C14 alkyl polyglucoside surfactant with an average degree of polymerization of between about 1 and about 2.

13. The composition according to claim 1, wherein the composition has a pH range of from 6 to 14 as measured at 10 times dilution in distilled water at 20° C.

14. A method of manually washing dishware comprising the steps of:

a) delivering a composition according to claim 1 onto soiled dishware or a cleaning implement;

b) cleaning the dishware with the composition in the presence of water; and c) optionally, rinsing the dishware.

15. A method of manually washing dishware comprising the steps of delivering a composition according to claim 1 into a volume of water to form a wash solution and immersing the dishware into the solution.

16. The composition according to claim 1, wherein the composition comprises from about 60% to about 75% water.

17. The composition according to claim 1, wherein the primary co-surfactant is a betaine surfactant.

18. The composition according to claim 17, wherein the betaine surfactant is cocoamidopropylbetaine.

19. A hand dishwashing cleaning composition comprising:

A) from about 15% to about 40% by weight of the composition of a surfactant system comprising an anionic surfactant and an amine oxide co-surfactant, i) wherein the surfactant system comprises from about 73% to about 90% by weight of the surfactant system of the anionic surfactant, ii) wherein the anionic surfactant comprises an alkyl ethoxy sulfate surfactant or a mixture of an alkyl sulfate and an alkyl ethoxy sulfate surfactant, wherein the alkyl ethoxy sulfate surfactant or the mixture of the alkyl sulfate and the alkyl ethoxy sulfate surfactant has a weight average degree of branching of from 41% to 50%, an average degree of ethoxylation of between about 0.5 and about 0.9, and an average alkyl chain length of between $C_{12}$ and $C_{14}$; and iii) wherein the anionic surfactant and the amine oxide co-surfactant are in weight ratio of between about 2.5:1 and about 4:1; and B) from about 0.1% to about 2% by weight of the composition of a cyclic diamine selected from the group consisting of 2-methylcyclohexane-1,3-diamine, 4-methylcyclohexane-1,3-diamine and mixtures thereof.

* * * * *